US005850936A

United States Patent [19]

Umiker

[11] Patent Number: 5,850,936

[45] Date of Patent: Dec. 22, 1998

[54] IMPENETRABLE WALL ELEMENT

[75] Inventor: Hans Umiker, Egg, Switzerland

[73] Assignee: Schoeller-Plast S.A., Romont, Switzerland

[21] Appl. No.: 776,967

[22] PCT Filed: May 22, 1996

[86] PCT No.: PCT/EP96/02206

§ 371 Date: Jan. 23, 1997

§ 102(e) Date: Jan. 23, 1997

[87] PCT Pub. No.: WO96/37419

PCT Pub. Date: Nov. 28, 1996

[30] Foreign Application Priority Data

May 23, 1995 [DE] Germany ..... 195 18 955.8

[51] Int. Cl.[6] ..... B65D 25/04

[52] U.S. Cl. ..... 220/676; 220/921; 220/913; 220/670

[58] Field of Search ..... 220/4.28, 4.26, 220/1.5, DIG. 27, 676, 913, 469, 669, 670, 672, 660, 646, 918, 919, 921

[56] References Cited

U.S. PATENT DOCUMENTS

| | | | |
|---|---|---|---|
| Re. 14,471 | 5/1918 | Doble et al. | 220/918 |
| 941,013 | 11/1909 | Doble et al. | 220/918 |
| 1,205,521 | 11/1916 | Doble | 220/918 |
| 2,266,887 | 12/1941 | McCoy . | |
| 3,069,002 | 12/1962 | Hart | 220/4.28 |
| 3,587,908 | 6/1971 | Nickel | 220/4.26 |
| 4,039,708 | 8/1977 | Okada | 220/918 |
| 4,456,142 | 6/1984 | Burling | 220/921 |
| 5,154,302 | 10/1992 | Alcorn | 220/1.5 |

FOREIGN PATENT DOCUMENTS

| | | | |
|---|---|---|---|
| 0 358 881 | 3/1990 | European Pat. Off. . | |
| 0032783 | 3/1963 | Finland | 220/660 |
| 2 149 976 | 3/1973 | France . | |
| 2 712 872 | 6/1995 | France . | |
| 1034406 | 7/1958 | Germany | 220/4.26 |
| 1 079 353 | 8/1967 | United Kingdom | 220/676 |

*Primary Examiner*—Stephen J. Castellano
*Attorney, Agent, or Firm*—Price, Heneveld, Cooper, DeWitt & Litton

[57] ABSTRACT

An integral wall formation for fruit and vegetables containers made of plastic has an outer surface having a plurality of longitudinally extending outer legs wherein adjacent legs define outer apertures therebetween. An inner surface has a plurality of longitudinally extending inner legs wherein adjacent inner legs define inner apertures therebetween. At least a majority of the inner apertures are staggered with respect to the outer apertures and in combination therewith form openings in regular arrangement for airing goods stored in the container. At least one crossbar extends transversely to and is adjoined with the inner legs and outer legs.

12 Claims, 3 Drawing Sheets

Fig. 7
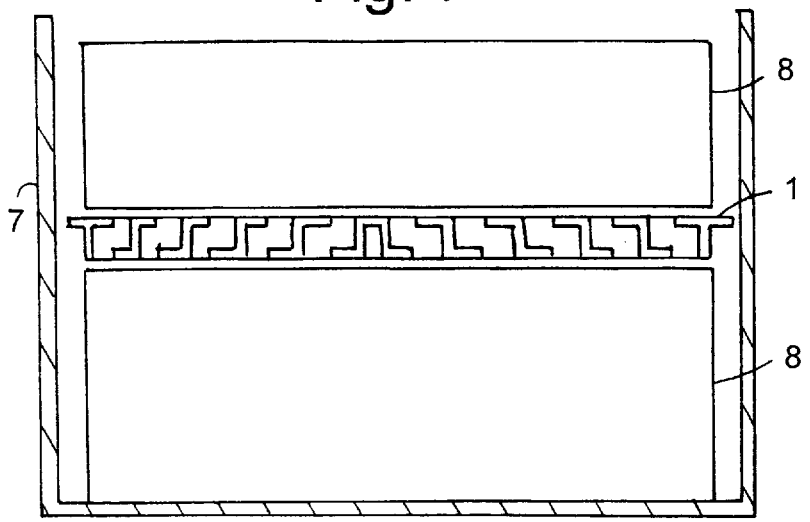
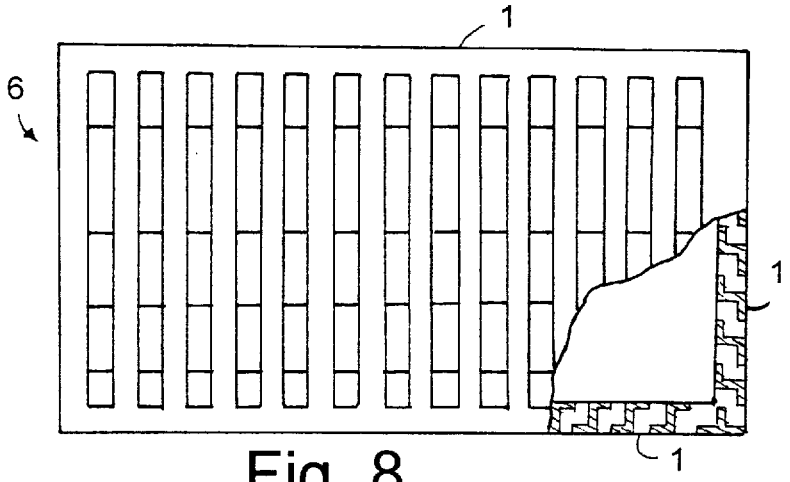
Fig. 8

IMPENETRABLE WALL ELEMENT

The present invention relates to bottom and side wall formations according to the preamble of claim 1.

A problem in the transport of perishable goods, for example fruit and vegetables, is the discrepancy between the lightness of the transport containers, which is generally obtained by an open bottom and side wall structure, and protection of the contained goods from damage. The main danger is of the contained goods being damaged from the outside, in particular in the case of fruit and vegetables, since when wooden containers or crates are interlocked in a stack for example, splinters can penetrate through the open structure of the side or bottom walls and enter the transported goods, making them unfit for sale, which can mean a considerable financial loss. A further problem with prior art containers is that the open formation of the bottom and side walls usually obtained by a crosswise arrangement of slats involves a latent danger of injury, since human extremities, e.g. fingers, can very easily be pinched and sprained during handling and transport when they get into one of the openings in the side or bottom walls during lifting, moving or stacking.

The problem of the present invention is to provide a side or bottom wall formation for transport containers or the like which has little weight due to an open structure, on the one hand, while preventing penetration of foreign bodies, on the other hand. Furthermore the side or bottom wall formation should be both stable and easy and economical to produce, and have a pleasing appearance to the eye.

According to the invention a side or bottom wall formation for boxes and containers, in particular plastic fruit and vegetable containers, is provided which has openings in preferably regular arrangement for airing the goods. The openings are limited by bars having legs at each end and disposed generally side by side a small distance apart. The connection of two legs by the bar thus results in a section, e.g. an I, S, T or Z shape, that limits the openings and is easy to produce by forming and permits very effective stiffening of the wall formation. The legs, which are preferably disposed in the planes of the sides of the side or bottom wall, are staggered so that, in a horizontal projection of the wall formation, the legs of one side are located in the area of the gaps between the legs of the other side, thereby preventing both a look through and penetration by objects at right angles to the superficial extension of the wall formation. As a result, at least some but preferably all openings have two laterally staggered aperture cross sections.

The section legs disposed side by side a small distance apart yield a smooth outside and inside surface of the wall formation which is gentle on the goods to be received, is easy to clean and produces a quiet external appearance. Since the section bars with their section legs permit a smooth formation of the inside and outside surfaces of the wall formation, the section legs disposed side by side a small distance apart offer a good labeling or printing surface so that the inventive wall formation also permits simple marking.

The side-by-side arrangement of the sections resulting from the legs and the connecting bars forms preferably labyrinthine openings therebetween, which favors the ventilation of the goods received in a container having the inventive wall formation. The labyrinthine nature of the openings in the wall formation, or the lateral stagger of the aperture cross sections, prevents objects from penetrating therethrough so that the contained goods are protected. Furthermore the inventive section bars result in a considerable stiffening of the wall formation in the direction of extension of the sections since the latter show high flexural strength with low use of material. To obtain stiffness in the wall formation direction perpendicular to the extension of the sections as well, the adjacent sections are preferably interconnected by cross bars which are preferably disposed at right angles to the extension of the sections themselves.

Since the sections show much higher flexural strength in comparison to prior art slats with a solid section, one can obtain a considerable saving of material with equal or greater stiffness of the wall formation here in comparison to solid sections, which contributes both to the lightness of the container in which the wall formation is used, and to a saving of resources.

The side-by-side arrangement of the sections, or the staggered arrangement of the section legs on both sides of the wall formation, furthermore results in good mold releasability of the wall formation e.g. if the latter is made of plastic. The mold seams are located on the inside, resulting in an advantageous external appearance of the wall formation which can contribute considerably to the acceptance of containers having such wall formations.

Depending on the case of application one can use an arrangement of sections in both the longitudinal and the transverse directions of the superficial extension of a side or bottom wall formation, or a tilt-symmetric arrangement of sections with respect to a surface tilting axis in the longitudinal or transverse direction, or a uniform arrangement of sections in one direction of extension of a wall formation. Tilt symmetry means that the openings of the wall formation halves would come to lie exactly on each other if the halves were tilted around a longitudinal or transverse center axis.

The inventive wall formation is suitable not only as a side or bottom wall formation for a transport container but also as a separating bottom for separating stacked layers or as an insertable bottom.

The inventive wall formation can be employed in particular as an integral wall and/or bottom element of a container producible from plastic by injection molding, in particular for vegetable or fruit containers which are formed of four rectangularly disposed side walls and a bottom.

In the following a preferred embodiment of the invention will be described with reference to the enclosed drawings, in which:

FIG. 7 shows a cross section of a container with a wall segment separating the container contents; and FIG. 8 shows a container comprising walls and a bottom formed from wall segments according to the preferred embodiment.

Figure 1:
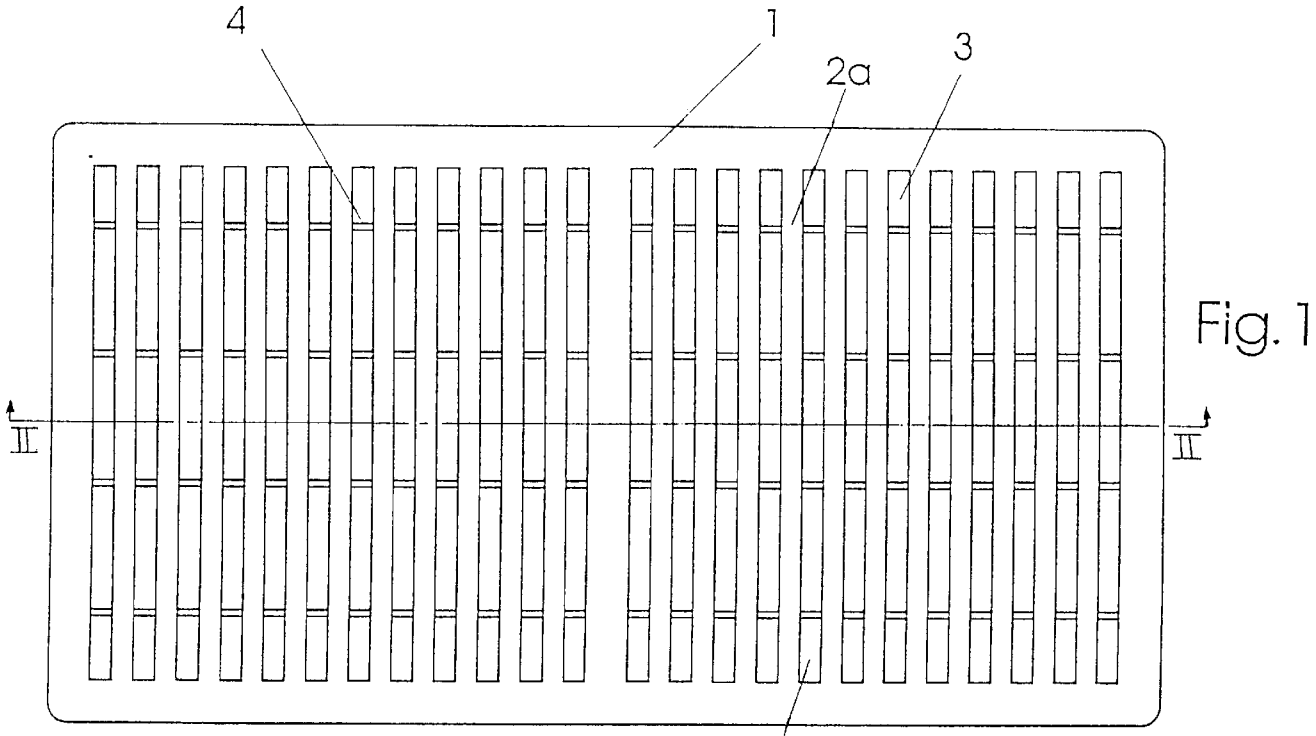
FIG. 1 shows a horizontal projection of an embodiment of the wall formation as a container wall.

FIG. 1 shows a horizontal projection of an embodiment of an impenetrable wall formation, here a container wall by way of example. The upper side of wall formation 1 is formed by section legs 2*a* disposed side by side a small distance apart so as to form a smooth outside surface which is easy to clean and shows an esthetic, quiet external appearance. Through spaces 3 between adjacent section legs 2*a* one can see section legs 2*b* which are disposed on the underside of the wall formation precisely in the area of spaces 3, thereby preventing a look through and penetration by objects through the wall formation. At right angles to the extension of section legs 2*a* and 2*b* there are four cross bars 4 in the embodiment shown in FIG. 1 which interconnect section legs 2*a* and 2*b* in the direction of the longitudinal extension of the wall formation. Instead of four cross slats 4 shown in this embodiment one can also use a different number of cross slats depending on the size and application of the wall formation. Instead of the rectangular form of the wall formation with round corners as shown in this embodiment one can also use any other form, such as round, oval or the like, the form depending merely on the intended purpose as a side wall, bottom wall or intermediate bottom and on the type and form of the container in which it is used.

Figure 2:
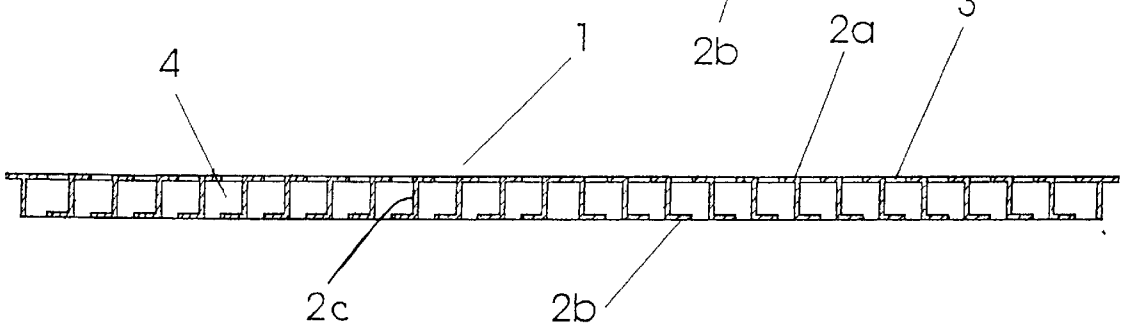
FIG. 2 shows cross section II—II according to FIG. 1.
Figure 5:
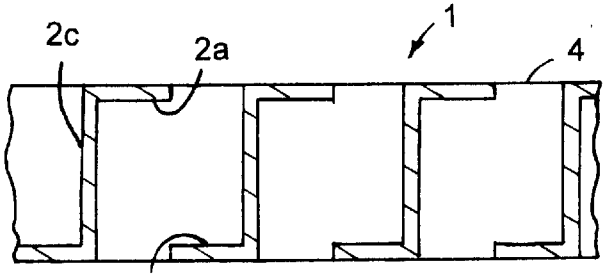
FIG. 5 shows a fragmentary cross section of a wall segment having S-shaped laterally extending sections.
Figure 6:
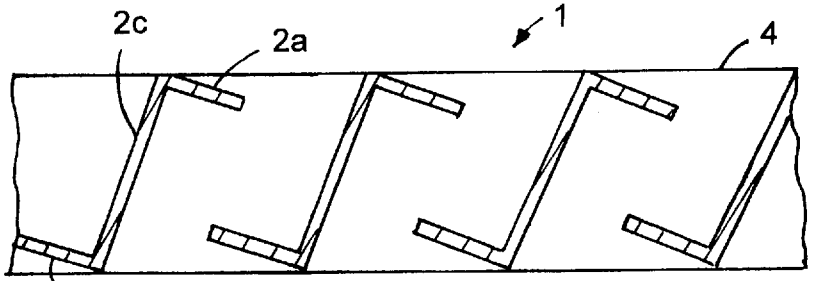
FIG. 6 shows a fragmentary cross section of a wall segment having tilt-symmetrical sections.
Figure 3:
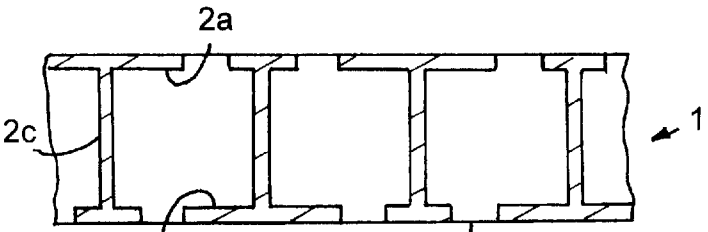
FIG. 3 shows a fragmentary cross section of a wall segment having I-shaped laterally extending sections.
Figure 4:
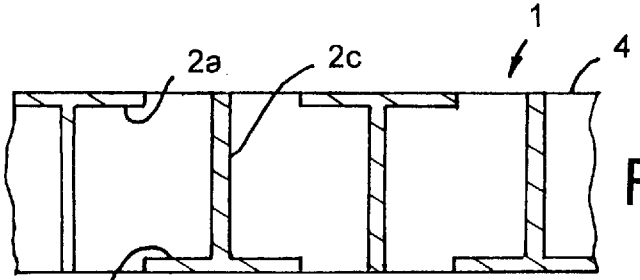
FIG. 4 shows a fragmentary cross section of a wall segment having T-shaped laterally extending sections.

FIG. 2 shows cross section II—II according to FIG. 1. One again sees section legs 2*a* and 2*b* which define the upper and lower superficial extension of the wall formations, two corresponding section legs of the upper side and underside of the embodiment being interconnected by bar 2*c* so that legs 2*a* and 2*b* and connecting bars 2*c* yield a section which is Z-shaped in this embodiment but may also be I-, T- or S-shaped. FIGS. 3–5, respectively, or tilt-symmetrical sections, FIG. 6. As evident from FIG. 2, sections 2 disposed side by side a small distance apart result in a structure which permits the passage of ventilating air but no penetration by objects through the spaces between adjacent sections 2. Sections 2 are interconnected by cross bars 4 disposed at right angles to the extension of sections 2. The high flexural strength of sections 2 results in high stability of the wall formation in the direction of sections 2 with a very low use of material as well as great lightness of the wall formation. The flexural strength in the longitudinal direction of the embodiment is obtained by the interconnection of sections 2 with the help of cross bars 4, resulting in a high total stability of the wall formation which also makes it suitable for use as walls and bottoms in stackable containers 6, (FIG. 8) or the like and as a stacking or separating element (FIG. 7) between layers 8 of fruit or vegetables in a container 7.

As likewise evident from FIG. 2, in the shown embodiment sections 2 are disposed tilt-symmetrically to the longitudinal center of this embodiment, which greatly contributes to the esthetic appearance of the wall formation, this being very important for the acceptance of a container having such wall formations by intended user circles. However this type of tilt-symmetric arrangement of sections 2 can be replaced by an arrangement in the same direction throughout without basically altering the function of the wall formation.

Depending on the application one can finally use a longitudinal arrangement of sections 2 instead of a transverse arrangement thereof, whereby cross slats 4 connecting sections 2 are accordingly aligned differently in connection with the shown embodiment.

The parallel arrangement of sections 2 as in the embodiment contributes furthermore to easy cleaning of the wall formation, which is very important particularly when the wall formation is used in reusable containers whose appearance must remain perfect after repeated use. Finally the wall formation according to the shown embodiment permits easy mold release if it is made from plastic, as is preferred, whereby the mold seams point inward and thus do not disturb the external appearance or involve any danger of injury by cuts.

I claim:

1. An integral wall formation for boxes and containers, said wall formation comprising:

an outer surface having a plurality of longitudinally extending outer legs wherein adjacent ones of said outer legs define outer apertures therebetween:

an inner surface having a plurality of longitudinally extending inner legs wherein adjacent ones of said inner legs define inner apertures therebetween, and further wherein at least a majority of said inner apertures are staggered with respect to said outer apertures and in combination form openings in regular arrangement for airing goods stored in the container; and at least one crossbar extending across said inner and outer apertures and transversely to and adjoined with said inner legs and said outer legs.

2. The wall formation of claim 1, characterized in that the laterally staggered apertures overlap each other.

3. The wall formation of claim 1, characterized in that the openings are formed as labyrinthine passages.

4. The wall formation of claim 1, characterized in that the openings are limited laterally by connecting bars which are formed as sections with said legs.

5. The wall formation of claim 4, characterized in that the section legs formed at one end of the bars form the inner surface of the wall formation, and the section legs formed at the other end of the bars form the outside surface thereof.

6. The wall formation of claim 5, characterized in that the inside surface legs and outside surface legs of the bars form smooth inside and outside surfaces.

7. The wall formation of claim 4, characterized in that the bars are formed as a cross section selected from the group consisting of S-, Z-, I-, and T-sections.

8. The wall formation of claim 4, characterized in that the bars are disposed parallel to each other at a small distance, and the inside surface leg of a bar is located in the area of the space between the outside surface leg of this bar and that of an adjacent section and covers the latter.

9. The wall formation of claim 1, characterized in that the sections are disposed tilt-symmetrically to one of the surface center axes.

10. The wall formation of claim 4, characterized in that the bars are disposed parallel to each other.

11. The wall formation of claim 4, characterized in that said at least one crossbar comprises a plurality of crossbars.

12. A wall formation for the construction of containers for the storage and transport of fruit and vegetables wherein said wall formation comprises a generally rigid planar sheet of polymeric material having an outer perimeter of predetermined dimensions and an inner portion defined by said perimeter, said inner portion having a first surface having a plurality of first apertures and a second surface having a plurality of second apertures staggered from said first apertures and in combination therewith defining a plurality of openings therethrough for allowing air to flow to the fruit and vegetables, said openings separated by a plurality of connecting bars of said rigid sheet, and further wherein said plurality of connecting bars define a majority of said openings such that each of said majority of said openings includes one of said first apertures staggered from one of said second apertures, and a crossbar separating said first surface from said second surface and extending transversely to said connecting bars.

* * * * *